US005678691A

United States Patent [19]

Amado-Aguilar et al.

[11] Patent Number: 5,678,691

[45] Date of Patent: Oct. 21, 1997

[54] CORNER ELEMENT AND A PACKING SYSTEM FOR THE TRANSPORTATION OF GLASS SHEET PACKAGES

[75] Inventors: Miguel Angel Amado-Aguilar; Rubén Cuellar-Vázquez; Hugo Jaime Herrera-Campos; Juan Manuel Ramos-Rodriquez; Juventino Cesar Villarreal-Garza, all of Nuevo Léon, Mexico

[73] Assignee: Vidrio Plano, S.A. De C.V., Garza Garcia, Mexico

[21] Appl. No.: 503,728

[22] Filed: Jul. 18, 1995

[30] Foreign Application Priority Data

Jul. 20, 1994 [MX] Mexico ..... 945521

[51] Int. Cl.[6] ..... B65D 85/48; B65D 81/00

[52] U.S. Cl. ..... 206/451; 206/586

[58] Field of Search ..... 206/586, 521, 206/453, 448, 449, 451, 454, 455, 456, 597; 248/345.1

[56] References Cited

U.S. PATENT DOCUMENTS

| | | | |
|---|---|---|---|
| 749,834 | 1/1904 | Beisel | 206/586 X |
| 1,873,887 | 8/1932 | Heppes | 206/451 X |
| 2,792,252 | 5/1957 | Ernst | 206/449 X |
| 3,416,652 | 12/1968 | Almasy | 206/453 |
| 3,443,684 | 5/1969 | Taylor | 206/586 X |
| 3,709,358 | 1/1973 | Andrews et al. | 206/451 |
| 4,134,496 | 1/1979 | Smith | 206/453 |
| 4,784,269 | 11/1988 | Griffith | 206/453 |
| 4,877,673 | 10/1989 | Eckel et al. | 206/453 X |
| 4,885,139 | 12/1989 | Werner et al. | 206/586 |
| 5,175,041 | 12/1992 | Webb et al. | 206/586 X |

*Primary Examiner*—Jimmy G. Foster

*Attorney, Agent, or Firm*—Abelman, Frayne & Schwab

[57] ABSTRACT

A corner element for use in forming a package of glass sheets comprises two corner pieces, each of which includes a first and a second planar arm, said first and second planar arms forming a right angle. The first and second arms are each formed with a planar projection extending at right angles from each arm, each planar projection being attached on the first and second arms in a position different with respect to each other so that when the two pieces are interfit with each other, the planar projections of one corner piece and the planar projections of the other piece form a protective enclosure around each one the corners of the sheet glass package. A post extending horizontally outwardly from one of the planar projections of each corner element is used to lift the glass sheet package to be transported.

10 Claims, 5 Drawing Sheets

CORNER ELEMENT AND A PACKING SYSTEM FOR THE TRANSPORTATION OF GLASS SHEET PACKAGES

BACKGROUND OF THE INVENTION

Prior to the time of the present invention, the transportation of flat glass sheets, in packages, had been effected in wooden boxes. This manner of doing things forced the production of boxes with hundred of different measurements and each box was specifically manufactured for each package. When the transportation was made, the box occupied part of the space which should be reserved for the glass, for example, 10 average sized boxes occupied up to 18 square meters. The boxes could not be used again since they were destroyed when the unpacking procedure took place.

Another disadvantage was that the unpacking operation took up to 15 minutes to be carried out.

An additional disadvantage is that, due to the great size of the wooden boxes, these also are presenting a problem of space within the warehouse. This is, due to the great size of the boxes, said boxes are occupying more cubic meters in the warehouses, which could be reserved to store more glass sheets.

With the present invention, the packing of glass sheets with boxes is substituted, including all their disadvantages. This invention then, consists of a novel corner element to be coupled on each corner of a glass sheet package and a packing system for the handling and transportation of glass sheets.

From the above, a first object of the present invention, besides solving the previously indicated problems, is less expensive, and it can be applied to packages which are less fragile, which do not require packaging material and which permit the product's inspection from the very moment that the customer receives the same.

An additional object of the packing system is that does not require more than a single tool to assemble the package.

Is other additional object of the present invention is to provide a packing system, which is adaptable to packaging any size (length and width) of glass sheets and particularly, permits any variation in the number of glass sheets.

An additional object of the present invention is to provide a packing system, which is constituted by two support corners of a standard size, which are adaptable to any size and number of glass sheets.

DETAILED DESCRIPTION OF THE INVENTION

Figure 1:
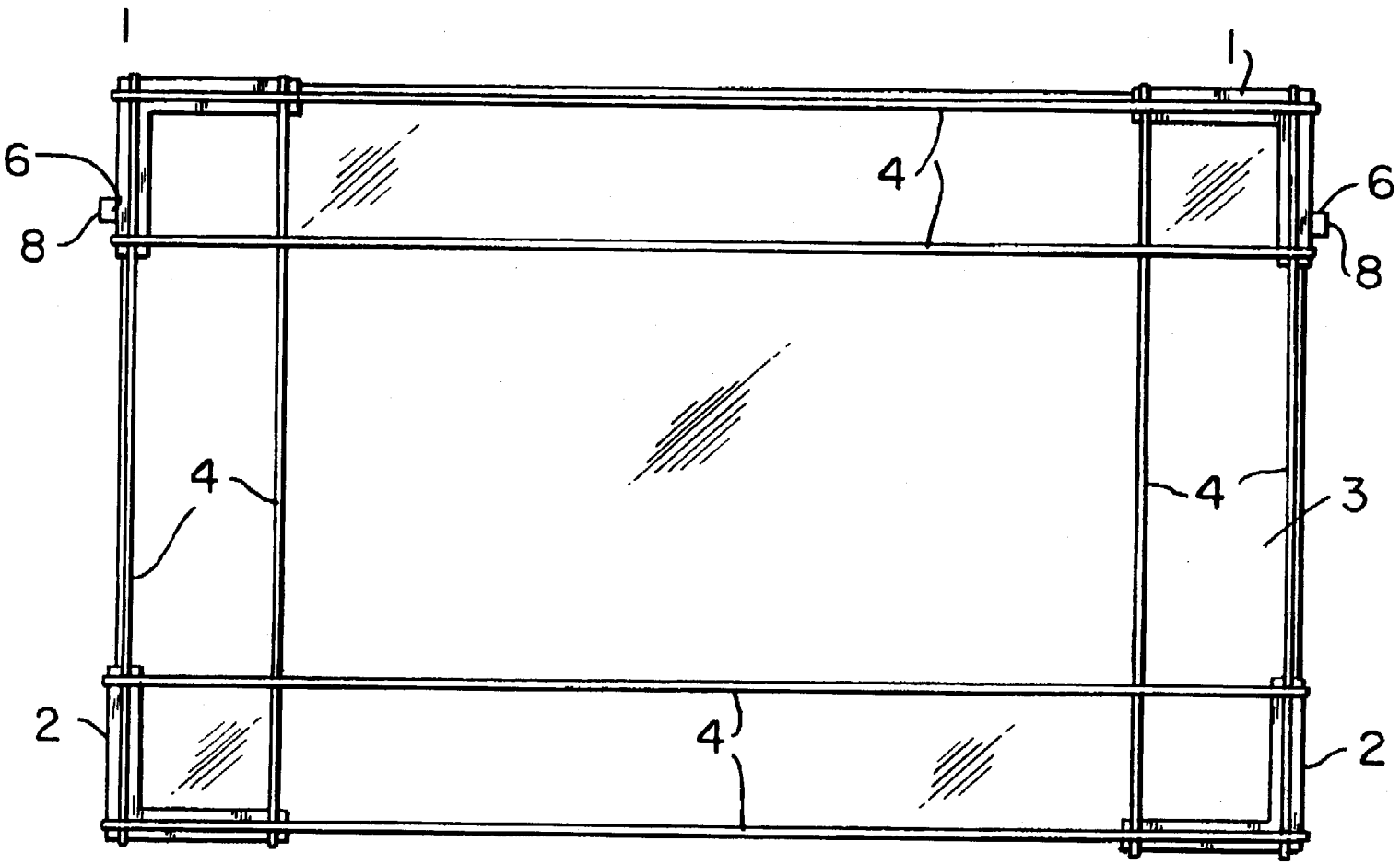
FIG. 1 is a side view of the package formed by the corner strapping system of the present invention.
Figure 2B:
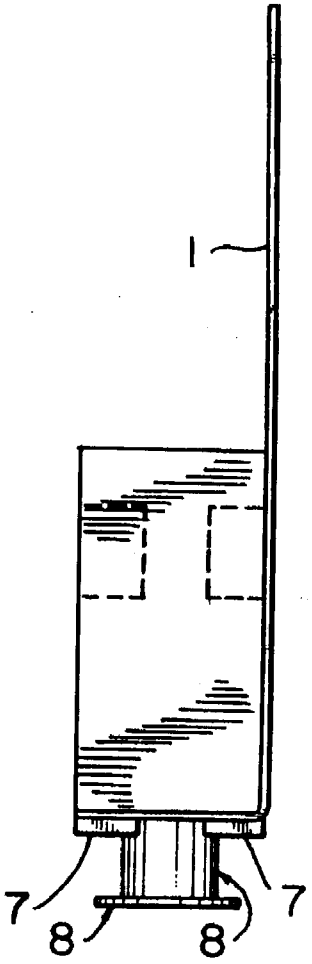
FIG. 2B is a top view of the corner piece shown in FIG. 2A.
Figure 2A:
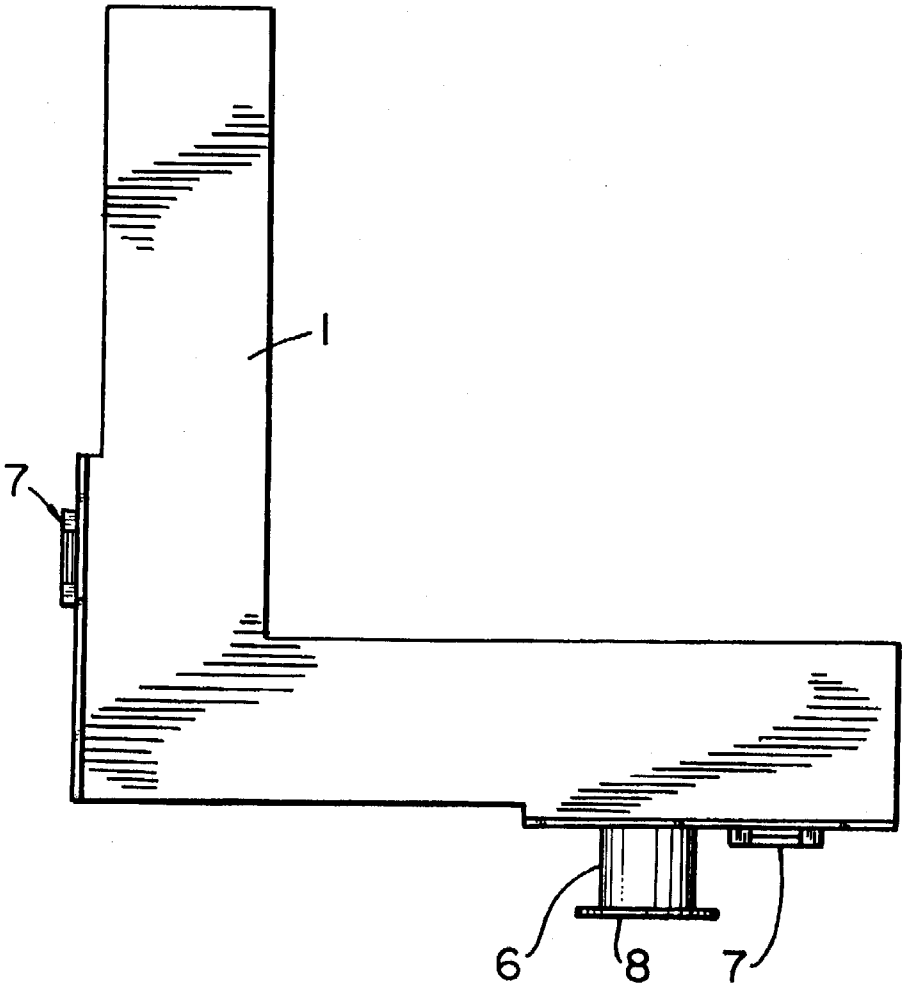
FIG. 2A is a side view of one of the pieces of the corner protector with a post.
Figure 3B:
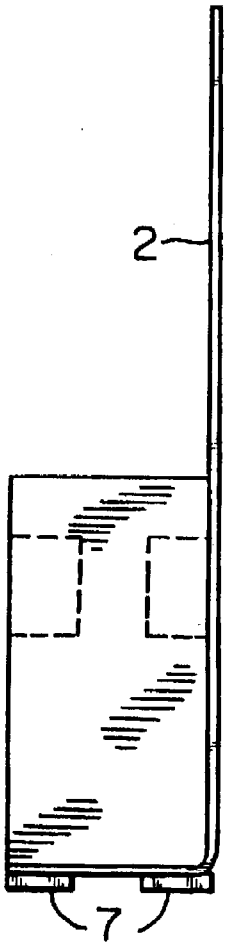
FIG. 3B is a top view of the corner piece shown in FIG. 3A.
Figure 3A:
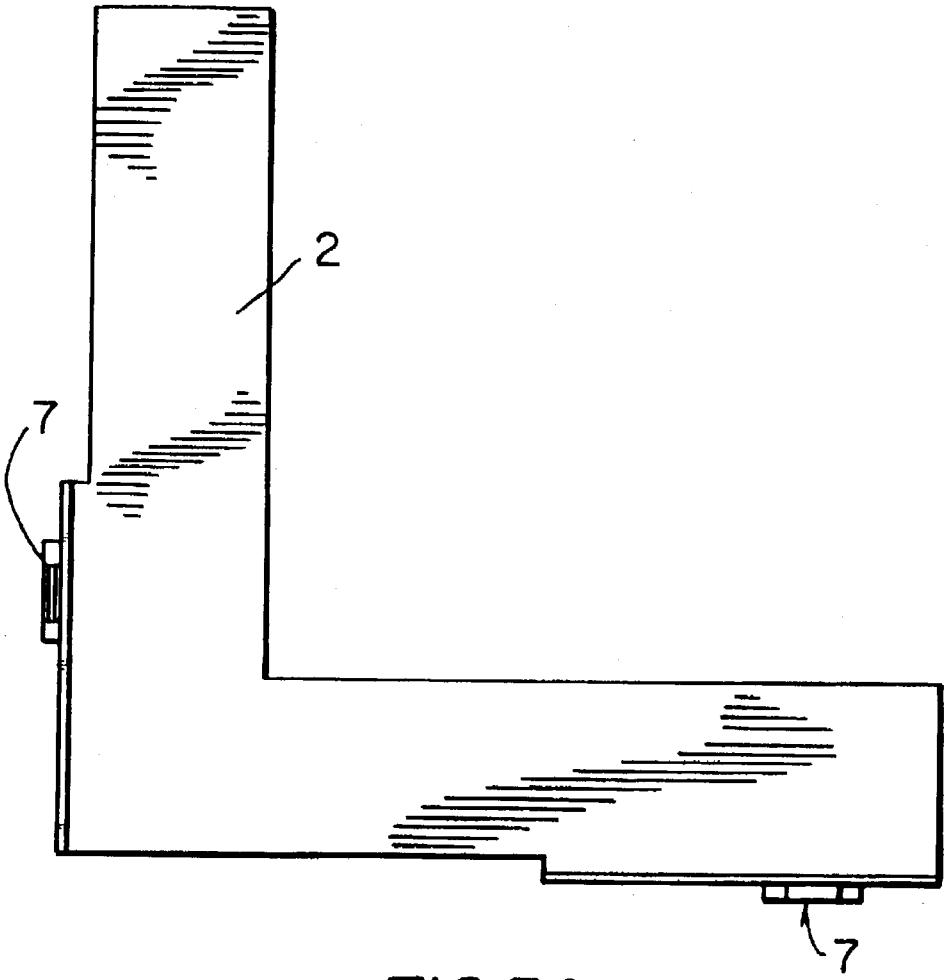
FIG. 3A is a side view of the other of the pieces of the corner protector without said pivot.

The packing system of the present invention comprises in combination, two basic pieces as is described in the following description:

Two pieces 1 and 2 to be assembled by pairs on each corner of a glass sheet packaging 3. The configuration of the pieces 1 and 2 are manufactured in the same size and form. The pieces 1 and 2 are configured as a flat square formed by two arms A and B, having the same length, and with their widths parallel to the plurality of glass sheets 3. The pieces 1 and 2 having two straight angle projections A' and B', in such a way that the width of the glass sheets will be covered by said projections. The projection A' is located in the free end of the first arm A. The projection B' is placed on the arm B, in coincidence with the upper part of the arm A (FIG. 4), in the corner formed by the 90 degree angle of the square. Each one of the projections A' and B' including a pair of strapping pads 7 over which a plurality of strapping bands 4 are coupled to slide for holding the glass sheet package 3 as will described later.

Additionally, the pieces 1 and 2 are lined with plush 5 on their inside surfaces, which will be in contact with surface of the glass sheet 3.

Figure 5:
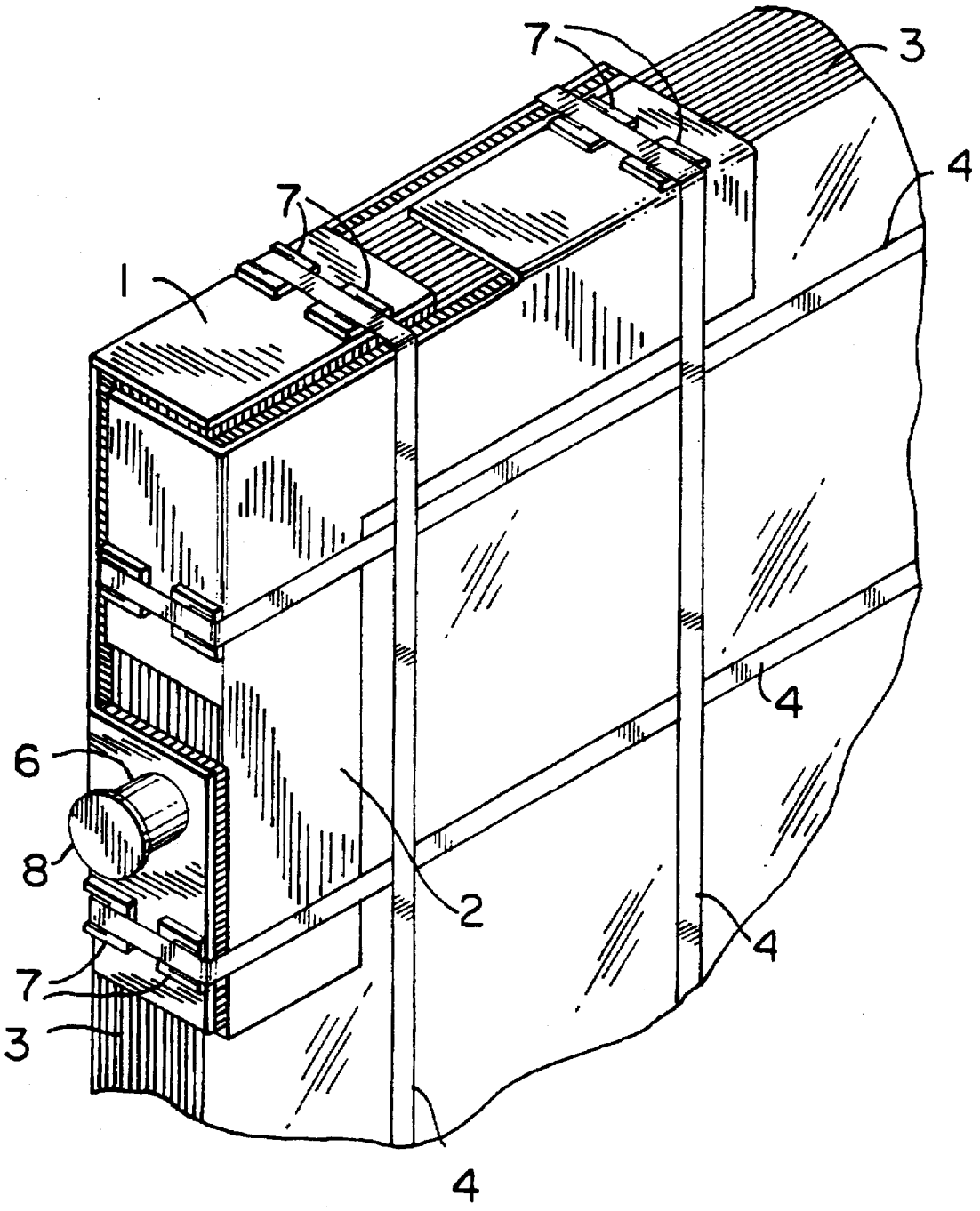

As is shown in FIG. 5, the projection A' of the piece 1 that is coupled in the upper corner parts of the glass sheet package 3 post 6 with a projecting cap or stop 8 on its extreme outside part. The post 6 is located in the upper part of the glass sheet 3, on the projection A' of the corner piece 1, in a horizontal position. Cables (not shown) are positioned on the posts 6 (FIG. 1), in order to lift and move the glass sheet packaging 3 from one side to the other.

Figure 4:
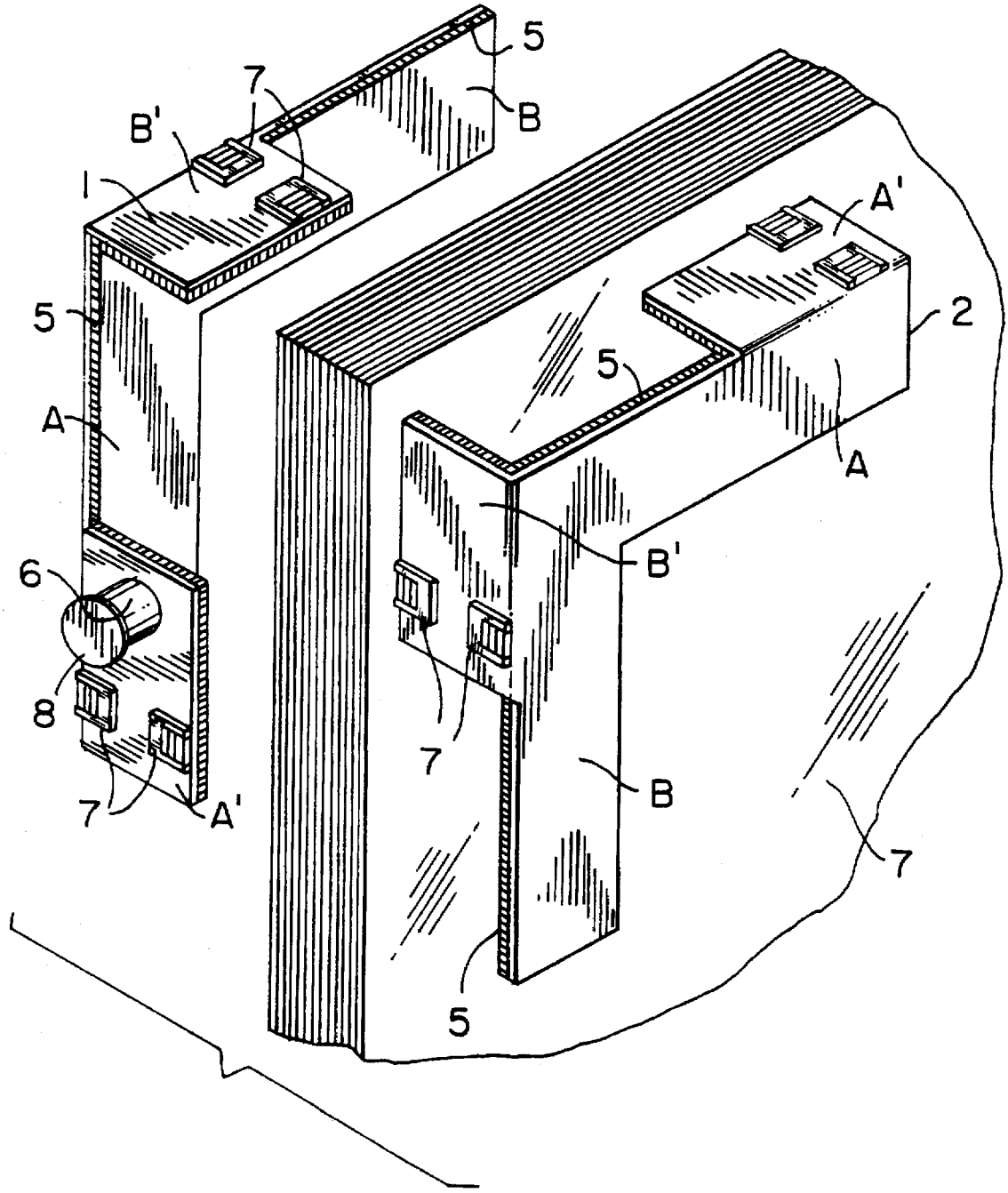
FIG. 4 is a exploded perspective view of the two corner pieces with post, when this is assembled on the upper corners of a glass sheet package; and, FIG. 5 is a perspective view of the strapping securing the two corner pieces in accordance with the present invention.

As previously was described, the pieces 1 and 2 are configured in the same form but, when these are assembled in each corner, these are made to coincide one in front of the other, in order to cover the corners of the glass sheets 3. The projection A' of each element A is placed in coincidence with the projection B' of each element B (FIGS. 4 and 5). The plurality of strapping bands 4 are arranged around of the glass sheets and are coupled on each corner, specifically on each pair of strapping pads 7, for holding the assembled glass sheet package 3.

Consequently, it must be understood that the invention is not limited to the specific embodiment disclosed above and that the persons having ordinary skill in the art could suggest other specific combination of components that will be within the inventive concept herein disclosed.

We claim:

1. A corner element for use in the assembly of a package of glass sheets, said corner element comprising first and second separate opposing corner pieces, each corner piece including a first planar arm and a second planar arm, said first and second arms forming a right angle, each of said first and second arms having at least one planar projection extending at a right angle, the at least one planar projection of the first corner piece being offset from the at least one planar projection of the second corner piece wherein the planar projections of the corresponding planar arms lie in adjacent interfitting non-overlapping relation such that the two corner pieces are brought into abutting relationship to enclose the corner of the sheet glass package.

2. The corner element of claim 1 which further comprises a lifting post affixed to the exterior surface of one of the planar projections, said post being normal to said surface and extending outwardly from the surface, for directly engaging means for lifting the glass sheet package.

3. A corner element of claim 2, wherein the post includes a cap.

4. The corner element of claim 1, wherein the corner pieces include cushioning material bonded to the interior surfaces that contact the glass.

5. The corner element of claim 1 wherein the corner pieces include strapping pads for receiving strapping bands.

6. An assembled sheet glass package comprising four corner elements, each corner element comprising two corner pieces, each corner piece including a first planar arm and a second planar arm, said first and second arms forming a right angle, each of said first and second arms having at least one planar projection extending at a right angle, the at least one planar projection of the first corner piece being offset with respect to the at least one planar projection of the other corner piece, whereby the two corner pieces interfit with each other, the at least one planar projection of one piece and the at least one planar projection of the other piece cooperating to enclose a corner of the sheet glass package; a plurality of strapping bands extending around the glass sheets and engaging each of the corner pieces; and a lifting post extending outwardly from one of the planar projections of at least two different corner elements for lifting the package.

7. The package of claim 6 wherein the corner pieces include cushioning material bonded to the interior surfaces that contact the glass.

8. The package of claim 6 wherein the post includes a projecting cap.

9. The package of claim 6 wherein the corner pieces include strapping pads for engaging the strapping bands.

10. The corner element of claim 3 where the post is generally cylindrical and includes a cap of larger diameter.

* * * * *